US005912064A

United States Patent [19]

Azuma et al.

[11] Patent Number: 5,912,064

[45] Date of Patent: Jun. 15, 1999

[54] DIAL PLATE FOR SOLAR BATTERY POWERED WATCH

[75] Inventors: Akira Azuma, Tokorozawa; Hisato Hiraishi; Takashi Toida, both of Tokyo, all of Japan

[73] Assignee: Citizen Watch Co., Ltd., Tokyo, Japan

[21] Appl. No.: 08/894,464

[22] PCT Filed: Apr. 8, 1996

[86] PCT No.: PCT/JP96/00964

§ 371 Date: Aug. 19, 1997

§ 102(e) Date: Aug. 19, 1997

[87] PCT Pub. No.: WO96/31810

PCT Pub. Date: Oct. 10, 1996

[30] Foreign Application Priority Data

| | | | |
|---|---|---|---|
| Apr. 7, 1995 | [JP] | Japan | 7-082681 |
| Apr. 21, 1995 | [JP] | Japan | 7-096607 |
| Oct. 27, 1995 | [JP] | Japan | 7-279937 |

[51] Int. Cl.[6] ..... G04C 10/00; H01N 6/36

[52] U.S. Cl. ..... 428/141; 428/701; 428/448; 428/446; 428/172; 428/173; 428/195; 428/213; 368/205; 368/228; 368/234; 368/232; 429/111; 136/251

[58] Field of Search ..... 428/701, 448, 428/446, 141, 172, 173, 195, 213; 368/205, 228, 234, 232; 136/251; 429/111

[56] References Cited

U.S. PATENT DOCUMENTS

| | | | |
|---|---|---|---|
| 3,793,824 | 2/1974 | Simon-Vermot et al. | 58/91 |
| 4,110,487 | 8/1978 | Rion | 427/27 |
| 4,126,728 | 11/1978 | Holleran et al. | 428/204 |
| 4,666,313 | 5/1987 | Ganter et al. | 368/205 |
| 5,243,578 | 9/1993 | Mathez | 368/88 |
| 5,438,556 | 8/1995 | Dinger et al. | 368/205 |
| 5,703,837 | 12/1997 | Umemoto et al. | 368/88 |
| 5,761,158 | 6/1998 | Azuma et al. | 368/205 |

FOREIGN PATENT DOCUMENTS

| | | |
|---|---|---|
| 61-49482 | 3/1986 | Japan . |
| 2-47518 | 12/1990 | Japan . |
| 5-45592 | 6/1993 | Japan . |

*Primary Examiner*—William P. Watkins, III

*Attorney, Agent, or Firm*—Armstrong, Westerman, Hattori, McLeland & Naughton

[57] ABSTRACT

The dial plate according to the present invention comprises a substrate formed of a ceramic material and a colored coating layer formed on the substrate. And, the colored coating layer is characterized by having a colored layer formed of a ceramic paint containing a metal compound as a principal component. The substrate formed of a ceramic material is porous; and hence, diffuses incident light to conceal a solar battery placed on the backside from view. Since the colored layer is formed of a ceramic paint containing a metal compound as a principal component, it is easy to firmly attach it to the substrate formed of a ceramic material and it is capable of forming various colors corresponding to the types of metal compounds applied.

23 Claims, 8 Drawing Sheets

DIAL PLATE FOR SOLAR BATTERY POWERED WATCH

TECHNICAL FIELD

The present invention relates to a dial for a solar battery powered watch activated by a solar battery energy.

BACKGROUND ART

Demand for watches which are virtually permanently usable in different countries where different types of batteries are used has progressively been increasing with the recent development of international distribution of watches. The market for solar battery powered watches, which are capable of meeting the aforesaid requirement, has rapidly expanded. Solar battery powered watches have attracted attention from the view point of worldwide environmental protection because the solar batteries of solar battery powered watches need not be replaced with new ones and solar battery powered watches will not cause environmental contamination due to the disposal of spent batteries.

Generally, a solar battery powered watch employs the solar battery itself as the dial plate and hence the surface of the dial plate assumes a dark purple appearance unique to the solar battery, which spoils the ornamental value of the watch and, consequently, places significant restriction on the design of the dial plate.

Thus, a dial is desired which enables the color thereof to be diversified so as to satisfy the various tastes of purchasers.

DISCLOSURE OF THE INVENTION

The present invention has been made in view of the foregoing circumstances and it is therefore an object of the present invention to provide a dial plate for a solar battery powered watch that conceals the color and electrode pattern of the solar battery from view while transmitting sufficient quantity of light to the solar battery, and which facilitates diversification of the color thereof.

With the forgoing object in view, the present invention provides a dial plate for a solar battery powered watch provided with a solar battery, to be disposed on the front side of the solar battery, comprising a substrate formed of a ceramic material, and a colored coating layer formed on a front surface of the substrate, wherein the colored coating layer has a colored layer formed of a ceramic paint containing a metal compound as a principal component.

Since the ceramic material per se is normally completely transparent relative to light and cannot absorb the incident light, and it is formed of a polycrystalline material and has many crystal grains, the substrate made of the ceramic material functions to irregularly reflect and diffuse the incident light. A part of the light incident on the dial plate does not transmit through the dial plate but irradiates from the surface of the dial plate owing to the diffusing function or operation and almost all the remaining incident light transmits through the dial plate and reaches the solar battery provided on the back surface of the dial plate.

The light reaching the solar battery is reflected therefrom, and a part of the light is again incident on the back surface of the dial plate and is irradiated from the front surface of the dial plate while it is subjected to the diffusing operation. Accordingly, the color and electrode pattern of the solar battery can be almost concealed from the viewer of the dial plate since the light irradiated from the front surface of the dial plate without transmitting through the dial plate and the light which is reflected from the solar battery and is irradiated from the front surface of the dial plate while it is subjected to the diffusing operation on the dial plate are overlaid upon each other.

Since the colored layer is disposed on the surface of the substrate, forming dial plates in various colors is possible. Since the colored layer is formed of a ceramic paint containing a metal compound as a principal component, it is firmly attachable to the substrate formed of a ceramic material, and various colors can be formed corresponding to the kind of a metal compound.

Forming an intermediate layer between the colored layer and the substrate, and forming the foregoing coating layer by the intermediate layer and colored layer are also possible. This intermediate layer can be formed of a glass film or an oxide film.

Since the intermediate layer is formed, keeping the ceramic paint from soaking into the base plate, reducing blurring in sight, and presenting a sharp color tone becomes possible.

Further, a surface layer formed of a glass film or oxide film on the surface of the colored layer may be formed. Forming the surface layer enables the colored layer to be protected and the dial surface to be made glossy.

Furthermore, smoothing by lapping the surface of the substrate and surface layer will restrict the irregular reflection of light on the surface and enhance the transmittance of light.

On the contrary, roughening the surface of the substrate and surface layer will strengthen the irregular reflection of light on the surface and produce a soft tone dial.

The present invention also provides a dial plate for a solar battery powered watch provided with a solar battery, to be disposed on a front side of the solar battery, comprising a substrate formed of a ceramic material, and a colored coating layer formed on a front surface of the substrate, wherein the colored coating layer is a mixed colored layer formed by a coloring material mixed with one of a glass material or an oxide material and a ceramic paint containing a metal compound as the principal component.

The mixed colored layer is formed of the coloring material mixed with a glass material or oxide material, and these materials by their nature restrict the ceramic paint from soaking into the substrate; thus making the color tone of the dial plate glossy as well as deep.

And, the coating layer may be formed by a surface layer formed of the glass film or oxide film on the surface of the mixed colored layer and the mixed colored layer.

The surface layer functions to make the surface of the dial plate glossy as well as protecting the mixed colored layer.

In the constitutions mentioned above, smoothing by lapping the front or rear surface of the dial plate, the surface of the mixed colored layer, or the surface of the surface layer will restrict the irregular reflection of light on said surface and enhance the transmittance of light.

On the contrary, roughening the surface of the substrate, the surface of the mixed colored layer, or the surface of the surface layer will strengthen the irregular reflection of light and present a soft tone to the dial plate.

The present invention also provides a dial plate for a solar battery powered watch provided with a solar battery, disposed on the front side of the solar battery, and having predetermined additive functional regions and a non-additive functional region on the front surface thereof, comprising a substrate which is formed of a ceramic material and provided with the additive and non-additive functional regions, on the surface of the dial plate, wherein the additive and non-additive functional regions differ in thickness from each other.

Since the additive functional and non-additive functional region are formed in different thicknesses, the transmittance and the diffusion coefficient of light are different in each of these two types of region. Consequently, these regions each appear in different color tones.

A colored layer of a coloring material containing at least a ceramic paint containing a metal compound as a principal component may be formed on at least either the additive functional regions or non-additive functional region.

When thus formed, the additive functional regions and the non-additive functional region assume different color tones, respectively, according to the color of the colored layer.

Further, forming the intermediate layer of a glass film or an oxide film between the colored layer and the substrate will keep the ceramic paint from soaking into the substrate and avoid blurring in sight, producing a deep tone.

Furthermore, forming the surface layer of a glass film or an oxide film on the surface of the colored layer will make the dial surface glossy as well as protect the colored layer.

The present invention further provides a dial plate for a solar battery powered watch provided with a solar battery, disposed on the front side of the solar battery, and having predetermined additive functional regions and a non-additive functional region on a front surface thereof, comprising a substrate which is formed of a ceramic material and provided with the additive and non-additive functional regions, wherein on at least one of the additive or non-additive regions the colored layer is formed of a coloring material containing at least a ceramic paint containing a metal compound as a principal component.

Thus, forming the colored layer will cause the additive functional and non-additive functional regions to appear in different color tones.

Forming the intermediate layer of a glass film or an oxide film between the colored layer and the substrate will hereat also keep the ceramic paint from soaking into the substrate and avoid blurring in sight, producing a deep color tone.

Furthermore, forming the surface layer of a glass film or an oxide film on the surface of the colored layer will make the surface of the dial plate glossy as well as protect the colored layer.

It is preferable to adjust the thickness of the substrate, colored layer, mixed colored layer, intermediate layer, or the surface layer described above, in consideration for the transmittance of light, that is, to adjust the transmittance of these layers so that a solar battery placed on the rear side of the dial can absorb the energy of light for driving the watch.

BEST MODE FOR CARRYING OUT THE INVENTION

Preferred embodiments of the present invention will be described hereinafter with reference to the accompanying drawings, in order that the present invention will be detailed in the content.

First Embodiment

Figure 1:
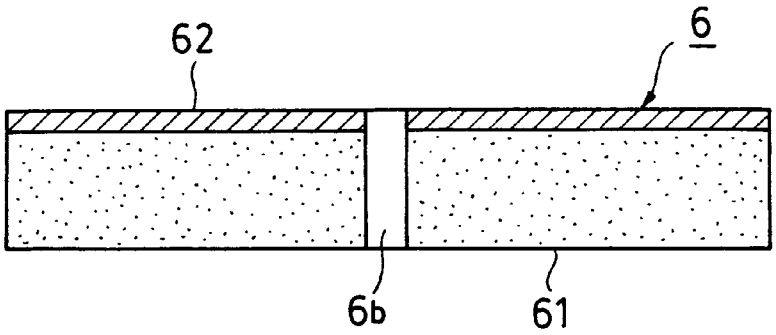
FIG. 1 is a sectional view showing the constitution of a dial plate for a solar battery powered watch relating to the first embodiment of the present invention.
Figure 2:
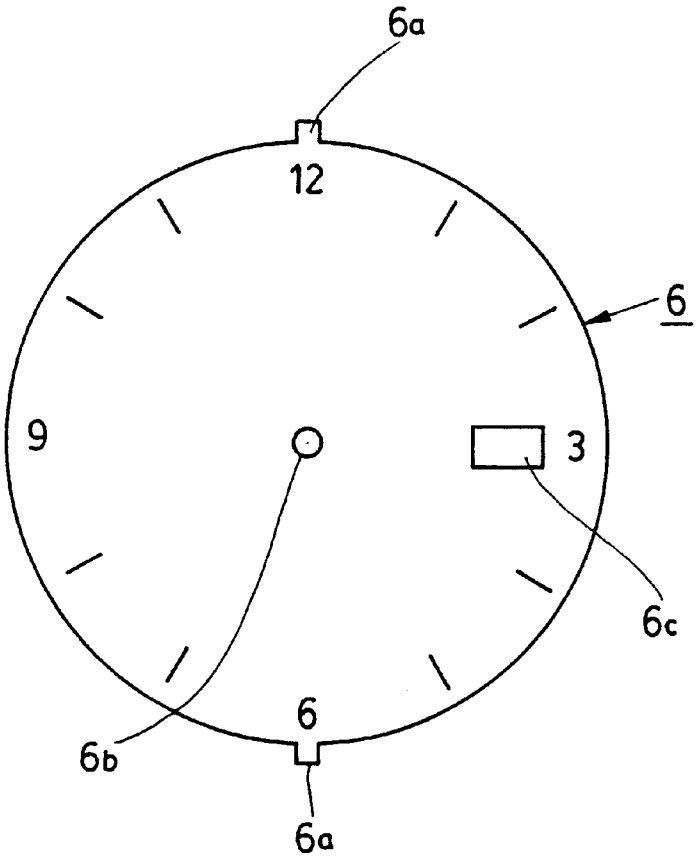
FIG. 2 is a plan view of the dial plate of FIG. 1.

FIG. 1 is a sectional view showing the constitution of a dial plate for a solar battery powered watch relating to the first embodiment of the present invention, FIG. 2 is a plan view of the dial plate of FIG. 1.

Figure 3:
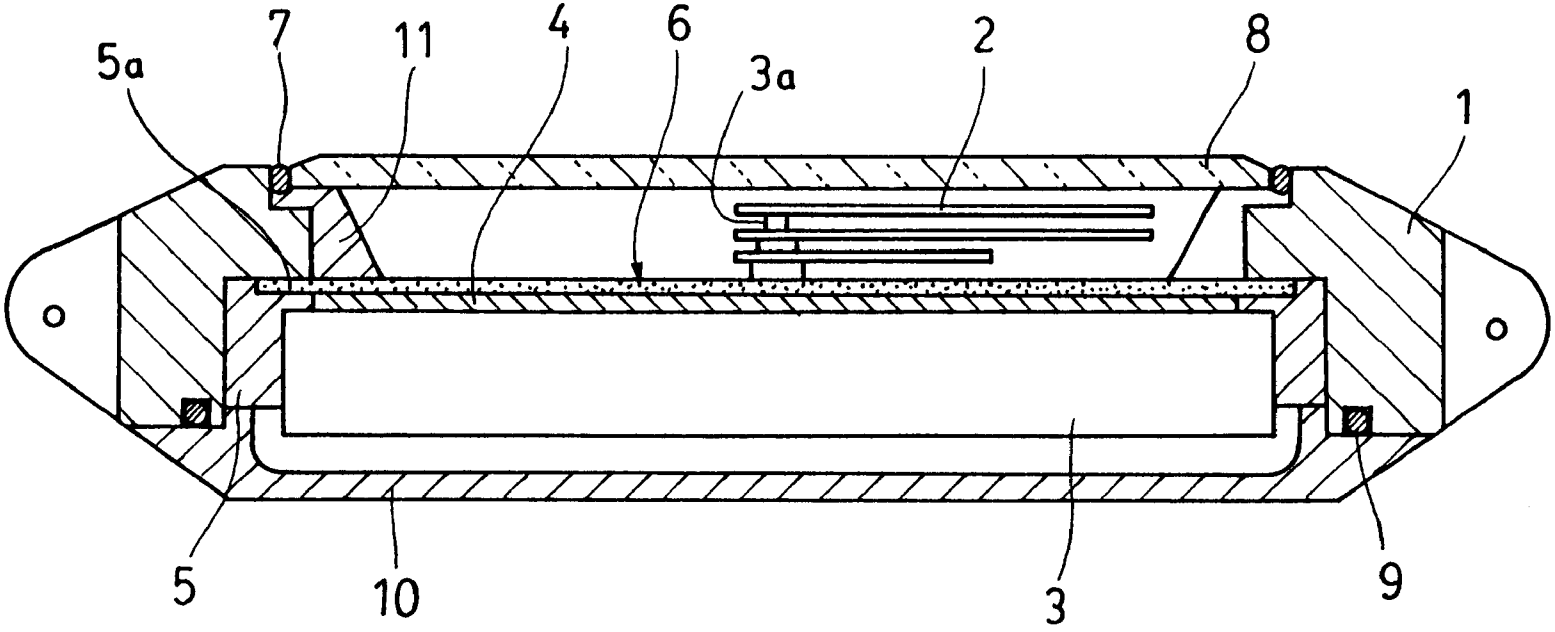
FIG. 3 is a sectional view showing the constitution of a solar battery powered watch in which a dial plate relating to the present invention is incorporated.

And, FIG. 3 is a sectional view showing the constitution of a solar battery powered watch in which a dial relating to the present invent incorporated.

First, the constitution of the solar battery powered watch will be described with reference mainly to FIG. 3. It is noted that the present invention is not limited in its practical application to the dial plate incorporated into the solar battery powered watch shown in FIG. 3.

As shown in FIG. 3, a movement 3 for turning hands 2 is contained in a case 1 having a front and a back open end. The movement 3 comprises a capacitor for storing energy generated by a solar battery 4, which will be described later, a quartz oscillator as the time base, a semiconductor integrated circuit that generates drive pulses synchronous with the generating frequency of the quartz oscillator, a stepping motor driven by the drive pulses to drive the hands 2 every one second, a wheel train mechanism for transmitting the driving force of the stepping motor to the hands 2, and the like.

An annular inner frame 5 formed of a resin is placed in the case 1 so as to surround the movement 3. A stepped part 5*a* to seat the dial plate 6 thereon is formed in one end of the inner frame 5, and the dial plate 6 is fitted in the stepped part 5*a*.

The depth of the stepped part 5*a* is substantially equal to the thickness of the dial plate 6, so that the surface of the dial plate 6 as fitted in the stepped part 5*a* is substantially flush with the end surface of the inner frame 5.

Formed in the circumferential surface of the stepped part of the inner frame 5 are, for example, two recesses (not illustrated). The dial plate 6 is provided with, for example, two projections 6*a* (FIG. 2) which engage with the recesses formed in the circumferential surface of the stepped part 5*a* to position the dial plate 6.

A solar battery 4 is installed on the rear side of the dial plate 6. The solar battery 4 functions to convert light energy into electric energy, as is well known.

And, a cover glass 8 is fitted in inside a front opening part of the case 1 through a second packing member 7 made of a resin or the like. On the other hand, a rear lid 10 is fitted in on a rear opening part of the case 1 through a first packing member 9 made of a rubber or the like. Fitting the cover glass 8 and the rear lid 10 in on the case 1 will keep the inside of the case 1 airtight and prevent dust, moisture, contaminants and the like from entering inside.

Further, an annular member 11 called a spacer is installed between the dial plate 6 and the cover glass 8. Mirror polishing is performed on the surface of the annular member 11, which serves to decorate the periphery of the dial plate 6.

As shown in FIG. 3, the inner frame 5 holding the movement 3, the solar battery 4, and the dial plate 6 is placed in the case 1. These members held by the inner frame 5 are clamped by the annular part 11 placed on the front side and the rear lid 10 placed on the rear side, thus preventing looseness.

A throughhole 6*b* (FIG. 2) is formed at the center of the dial plate 6, so that a shaft 3*a* for driving the hands can be projected through the center of the movement 3 to the surface side of the dial plate 6. Around the shaft 3*a*, a hand 2 including an hour hand, minute hand, and second hand are attached.

And, characters including a time scale and brand name, and other symbols are indicated on the surface of the dial plate 6. Further, an indicating window 6*c* for the date and the day of the week is formed on the dial plate (FIG. 2).

Next, the method of manufacturing the solar battery 4 will be described.

First, Kovar which is an alloy made of iron, nickel, and cobalt is pressed so that a supporting base plate is formed for the solar battery 4.

Two positioning pins (not illustrated) are attached, for example, by adhesive, or by spot welding on the rear side of the supporting base plate.

These positioning pins are to position and fix the solar battery 4 on the surface side of the movement 3; in assembling a watch, they are loosely put in positioning holes (not illustrated) formed on the movement 3. The solar battery 4 can be adhered directly on the surface of the movement 3 without forming the positioning pins.

Next, a glass layer as an insulating film is formed on the surface of the supporting base plate. The coefficients of linear expansion of the Kovar forming the supporting base plate and the glass layer are made virtually equal, which protects the glass layer from being damaged by temperature change.

The glass layer is formed in such a manner that a liquid glass film (SOG) is applied on the surface of the supporting base plate by the rolling application method, and then is baked under the temperature of 300° C. to 400° C. to evaporate the solvent contained in the applied glass film. The thickness of the glass layer formed is, for instance, 1 to 2 $\mu$m.

Next, a lower electrode (not illustrated) is formed on the surface of the glass layer by using a sputtering machine. The lower electrode is formed on an optional area on the surface with a thickness of about 1 $\mu$m by using aluminum containing silicon in 1% by weight (wt %).

Next, an antidiffusion layer made of chrome is formed with a thickness of 100 nm on the upper surface of the lower electrode by using the sputtering machine. The antidiffusion layer functions to hinder the lower electrode and the semiconductor layer from diffusing with each other. When the lower electrode is formed by a metal film of a high melting point or an alloy film of a high-melting-point metal and silicon, the antidiffusion layer can be omitted.

Further, in an optional area on the surface of the antidiffusion layer, a semiconductor layer made of a thin film non-crystalline silicon is formed which works as a solar battery.

An amorphous silicon layer, for example, can be applied for the non-crystalline film. The conductive type of the semiconductor layer, for example, is made to be an n-i-p structure in that order from the side of the antidiffusion layer.

Next, in an optional area on the surface of the semiconductor layer, a transparent electrode film is formed using indium tin oxide (ITO) as an upper electrode.

Finally, a protective film is formed on the surface by an acrylic resin or epoxy resin having a transmittance of light of about 99%, thus completing fabrication of the solar battery 4.

Next, the constitution of the dial plate 6 relating to the first embodiment will be described, mainly with reference to FIG. 1.

The dial plate 6 comprises a colored coating layer on the surface of the base plate 61.

The dial plate 6 is disposed on the front side of the solar battery 4 as shown in FIG. 3 and has a function to conceal the solar battery 4 from view, and another function contradictory to the previous function to transmit the light as much as possible so that the solar battery can secure a sufficient amount of solar energy or electric power. The adjustment of transmittance of light has very important meaning for the dial plate 6 of the solar battery.

For example, it is preferable that the dial plate 6 has a transmittance of light capable of transmitting ¼ or more of the irradiated light so as to secure sufficient electric power for the solar battery 4 and to keep a steady driving of the watch. Further, it is preferable that the dial plate of a watch provided with an additive function such as an illuminating or alarming function which consumes much power has a transmittance of light capable of transmitting ⅓ or more of the irradiated light.

Meanwhile, it is preferable that the dial plate has a transmittance of light capable of transmitting ⅔ or less of the irradiated light to conceal the solar battery 4 (particularly the color thereof) from view. Further, if the dial plate 6 has a light color, it is preferable that the dial plate has a transmittance of light capable of transmitting ½ or less of the irradiated light so as to more securely conceal the solar battery 4 having a dark color, such as dark violet.

In view of the security of the electric power and of the concealing of the solar battery 4, it is preferable that the transmittance of light of the dial plate 6 be adjusted.

A specific region of wavelength of the light incident on the dial plate 6 is absorbed by the colored coating layer. Meanwhile, since the amount of electric power of the solar battery 4 is varied depending on the region of wavelength of the incident light, it is useless if the dial plate transmits light in the region of wavelength which light does not contribute to the generation of the electric power of the solar battery 4. Accordingly, it is preferable that the transmittance of light of the dial plate 6 of the present invention be decided based on the light in the region of wavelength contributing to the generation of the electric power of the solar battery 4.

Accordingly, it is preferable that the transmittance of light of the dial plate 6 be decided based on the ratio between the amount of electric power of the solar battery 4 generated by the light irradiated on the solar battery 4 in a state where the dial plate 6 is not inserted and that of the solar battery 4 generated by the light transmitted through the dial plate 6 in a state where the dial plate 6 is inserted.

The substrate 61 is made of a ceramic material having a thickness ranging from about 0.1 mm to 0.5 mm. The thickness of the substrate 61 is properly adjusted considering the strength and the transmittance of light. That is, the thickness of the substrate 61 is adjusted to keep the strength capable of withstanding the usage of the dial plate of a watch and to secure a transmittance of light capable of transmitting about 30 to 70% of the irradiated light considering the attenuation of quantity of light transmitting through the colored coating layer.

The substrate 61 is formed of a ceramic material which contains, for instance, alumina or zirconia as a principal component.

Light incident on the substrate 61 made of the ceramic material is reflected irregularly on the surface and in the inside of the substrate 61, and a portion of incident light is reflected from the substrate 61. On the other hand, after irregularly reflecting inside the substrate 61, light transmitted through the substrate 61 reflects on the solar battery 4, again reflects irregularly on and inside the substrate 61, and a portion thereof again transmits through the substrate 61. Through a process of reflection and transmission caused by a series of irregular reflections, the color of the solar battery 4 and the electrode pattern is substantially concealed from view.

The colored coating layer is comprised of a colored layer 62 formed of paint (ceramic paint) for painting ceramics.

The ceramic paint contains a metal compound as a principal component, and is formed in such a manner that a metal oxide as the metal compound is dispersed into water or oil and the viscosity thereof is adjusted by using funori (liquid glue of a marine alga) or the like, or is a liquid pigment paint in which water-soluble metallic chloride as the metal compound is dissolved into water. Different kinds of metal compound can be used to assume different colors.

Using cobalt chloride or cobalt nitrate as the metal compound for the liquid pigment paint will produce a blue colored layer 62. Using iron chloride or iron sulfate will produce a yellow colored layer 62. Using ferric chloride or copper sulfate will produce a green colored layer 62. Using chromium sulfate or chromium nitrate will produce a brown colored layer 62. Using gold chloride will produce a pink colored layer 62.

Thus, selection of the kind of the metal compound will present various colors needed for designing the dial plate 6 for the watch.

Further, mixing several kinds of the metal compounds described above in an appropriate ratio will produce a colored layer 62 having various tones.

Mixing, for instance, metal oxides of cobalt and chrome will produce a green spectrum colored layer 62. Mixing metal oxides of cobalt and manganese will produce a blue spectrum colored layer 62. Mixing metal oxides of gold and cobalt will produce a red-purple spectrum colored layer 62.

Furthermore, these paints are what is called an underglaze paint which is usually processed under a baking temperature of 1100 to 1300° C.; however, adding a frit of lead derivatives will produce what is called an overglaze paint which develops its color under a low baking temperature of 700 to 900° C.

Next, the method of manufacturing the dial plate 6 relating to the first embodiment will be described by dividing it into the manufacturing method of the substrate 61 and the formation of the colored coating layer.

First, the method of manufacturing the substrate 61 will be described.

A ceramic material with a binder added is filled in into a metal mold. The metal mold forms its inner shape so as to form the external shape of the dial plate 6, the throughhole 6*b*, the indicating window 6*c* and the like.

Alumina or zirconia with a grain diameter of about 0.3 $\mu$m is used for the ceramic material. The binder is added in by about 3.0% to the ceramic material. It is preferable to use alumina or zirconia having a purity of more than 99.9%. And, polyvinylalcohol (PVA), for example, is used for the binder.

A pressing treatment is executed by using a press machine on the metal mold in which the foregoing materials are filled in. The pressure thereat is about 1 ton/cm$^2$.

Next, a first baking treatment is executed to remove the binder added in the ceramic material. The first baking treatment is conducted under the temperature of about 1200 to 1400° C., taking about 120 minutes for the baking time. The ambient atmosphere for the baking treatment is air. Since the first baking treatment removes the binder, the outside dimension of the ceramic material becomes slightly smaller, however the thickness virtually does not change.

Next, a second baking treatment is executed. The second baking treatment is conducted under a temperature (for example, 1500 to 1900° C.) where the sintering of the ceramic material is accelerated, taking about 300 minutes for the baking time. The ambient atmosphere for the baking treatment is hydrogen gas. The second baking treatment advances crystallization of the ceramic material so that the grain diameter becomes larger than 0.3 $\mu$m.

Thus, as the grain diameter of the ceramic material enlarges, the area of the crystal grain boundary in the substrate 61 reduces; consequently, irregular reflection on the surface of the crystal grain boundary is restricted, which increases the transmittance for light.

After the second baking treatment is complete, the front and rear surface of the substrate 61 are flattened by using a grinding machine. Diamond abrasive grains, for example, are used for the grinding machine. The thickness of the substrate 61 is made about 0.3 mm by this grinding.

Next, a third baking treatment is executed on the substrate 61. The baking temperature (for example, 1200 to 1400° C.) is lower than that of the second baking treatment. The third baking treatment is conducted in air, taking about 120 minutes for the baking time, to remove contamination attached on the surface of the substrate 61.

Next, a barrel polishing is executed on the substrate 61 by using a barrel machine. The barrel polishing is conducted by using, for example, copper (Cu) balls. This barrel polishing decreases the surface roughness of the substrate 61, and still further increases the transmittance of light of the substrate 61. And, the barrel polishing can remove burrs made on the outer rim and the corner of the substrate 61, and can give roundness on the corner.

Finally, a fourth baking treatment is executed on the base plate 61. The baking temperature thereat is comparable to that of the third baking treatment. The fourth baking treatment is conducted in air, taking about 120 minutes for the baking time. This fourth baking treatment removes contamination attached on the surface of the substrate 61 to keep the surface clean.

Provided that the substrate 61 can be firmed to be flat as well as so that the dispersion of the thickness can be reduced by the pressing treatment and the first and second baking treatment in the manufacturing process of the substrate 61 as described above, the grinding and the third baking process may be omitted.

Instead of pressing in a metal mold the substrate 61 can also be made, for example, by pressing a green sheet, and thereafter by baking it. And also, the substrate 61 can be made with a powder injection molding, by conducting the baking treatment.

The surface of the base plate 61 may be made a smooth surface with a surface roughness of about 0.05 to 0.1 μm by lapping or the like. This will restrict the irregular reflection of light on the surface thereof (finally, the interface with the colored layer 62) and enhance the transmittance of light. Consequently, the quantity of light reaching the solar battery 4 placed on the rear side of the dial plate 6 increases, so that the solar battery generates more electromotive force.

Lapping can be done by using diamond abrasive grains having a grain diameter of about 3 μm.

On the contrary, barrel or honing processing can roughen the surface of the substrate 61. In this case, the irregular reflection is strengthened on the surface (finally, the interface with the colored layer 62) of the substrate 61, and the transmittance for light is decreased; however, the irregular reflection of light will present soft and warm color tones.

Next, the method of forming the colored coating layer will be described.

The colored layer 62 is formed on the surface of the substrate 61 made of the ceramic material formed by the method described above. In this case, both the underglaze paint of a high temperature baking type and the overglaze paint of a low temperature baking type can be used. The colored layer 62 is formed by using a ceramic paint of a desired color. The thickness of the colored layer 62 may be adjusted to about 5 μm to 10 μm.

The ceramic paint forming the colored layer 62 is so adjusted that metal oxide such as cobalt oxide and water are mixed in the ratio of 8 to 2, and further an equal quantity (10) of glycerin is added to form the mixture into a liquid state. Oil of balsam, turpentine, or lavender may be used instead of water for a solvent.

The ceramic paint is applied on the surface of the substrate 61 by the screen printing method, rolling application method, and manual operation by a writing brush or paint brush. And, using the screen printing method the ceramic paint is applied onto a transfer paper and dried, and thereafter, a covercoat is formed on the upper surface thereof. Next, the ceramic paint is transferred onto the covercoat, which is peeled off from the transfer paper so as to be transferred to the surface of the substrate 61; thus the colored layer 62 may be formed.

Afterward, a baking treatment is conducted under a temperature of 750° C. to 800° C., so that the colored layer 62 having a desired color can be made on the surface of the substrate 61.

This baking treatment is executed in an atmosphere, for example, of oxidation or reduction. The treatment in the atmosphere of oxidation or reduction develops different color tones even if the same ceramic paint is used. And, the color tone differs depending on the difference of the film thickness of the colored layer 62 so formed. Therefore, changing the film thickness will give a different color tone or a different feel of material to the colored layer 62.

Afterward, time scales, characters, symbols and the like are formed on the surface of the colored layer 62 depending on the need.

Since the colored layer 62 is formed of the ceramic paint containing a metal compound as a principal component, the surface is formed to be rough. When the surface of the colored layer 62 is kept as rough as in the above, the irregular reflection of light will give soft and warm color tones.

On the other hand, the surface of the colored layer 62 may be made smooth with the surface roughness of about 0.05 to 0.1 μm by lapping or the like. This will restrict the irregular reflection of light on the surface thereof and enhance the transmittance of light. Consequently, the quantity of light reaching the solar battery 4 placed on the rear side of the dial plate 6 increases, so that the solar battery generates more electromotive force.

Lapping can be done by using diamond abrasive grains having a grain diameter of about 3 μm.

Figure 4:
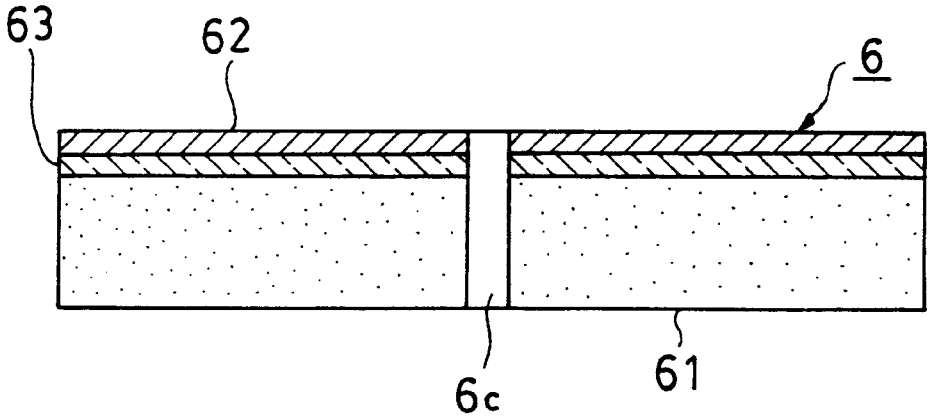
FIG. 4 is a sectional view showing the modified embodiment of a dial plate for a solar battery powered watch relating to the first embodiment.

FIG. 4 is a sectional view showing one modified embodiment of the dial plate for a solar battery powered watch relating to the first embodiment described above.

In this modified embodiment, the colored coating layer comprises the colored layer 62 described above and an intermediate layer 63.

The substrate 61 in this modified embodiment is substantially the same as the one described in the first embodiment, thus a detailed description thereof will be omitted.

The intermediate layer 63 is formed in an intermediate area between the substrate 61 and the colored layer 62.

This intermediate layer 63 is formed by a glass material containing silicon such as a glaze (glaze for ceramics) used for making ceramics.

This ceramic glaze, containing silicon, is formed into a glossy glass film by a baking treatment.

What can be used for the ceramic glaze are materials containing natural inorganic materials, such as feldspar, silica rock, lime stone, talc, ash, etc., and materials containing chemical materials, such as zinc white, white lead (karatsuti), red lead, barium carbonate, soda ash, frit, etc.

These ceramic glazes are formed into the intermediate layer 63 by the baking treatment under a high temperature of, for example, 1100 to 1300° C. The intermediate layer 63 formed on the surface of the substrate 61 functions to clog fine holes on the surface of the substrate 61 formed of a ceramic material and keep the colored layer 62 from soaking into the substrate 61.

In this modified embodiment, it is preferable to select the ceramic paint used for forming the colored layer 62 which has a baking temperature sufficiently low (for example, 700 to 900° C.) compared to that of the ceramic glazes used for forming the intermediate layer 63.

Therefore, using an overglaze paint of a low baking temperature type for the ceramic paint will remove the risk of softening the intermediate layer 63 formed beforehand on the surface of the substrate 61, in the baking of the colored layer 62.

Generally, there are achromatic transparent and light-colored ceramic glazes used for forming the intermediate layer 63. Using the light-colored ceramic glaze for forming the intermediate layer 63 will mix the color of the colored layer 62 with the color of the intermediate layer 63 and present a still different color expression. When the transmittance of light is needed to be kept at a high level, it is preferable to use an achromatic transparent ceramic glaze also for this intermediate layer 63.

The intermediate layer 63 can be formed, for example, according to the following method.

After a ceramic glaze as described above is selected and dispersed in water and churned, the glaze is applied on the surface of the substrate 61 by means of the screen printing method, rolling application method, or manual operation by a writing brush or paint brush. Then, the applied surface is processed under a baking temperature of 1100 to 1300° C., thus forming the intermediate layer 63. This baking treatment is done in an atmosphere of oxidation or reduction.

The thickness of the intermediate layer 63 may be adjusted to, for example, about 5 μm to 10 μm.

This intermediate layer 63 can be formed of various glass materials other than the ceramic glaze. For a glass material used for forming the intermediate layer 63, a high melting point glass having a baking temperature of, for example, 950 to 1300° C. can be used, the baking temperature of which is sufficiently high compared to that of the ceramic paint used for forming the colored layer 62. The reason is that, if the baking temperature for the intermediate layer 63 is lower than that for the colored layer 62, the intermediate layer 63 will be melted and be mutually diffused with the colored layer 62 when the colored layer 62 is formed.

This high melting point glass as well as a low melting point glass is made into glass powder, which is mixed with a vehicle into a paste. The paste is applied by a screen printing method, writing brush, or paint brush and baked. Ethylcellulose dissolved in a-terpineol may be used as the vehicle.

The surface of the intermediate layer 63 may be made smooth with a surface roughness of about 0.05 to 0.1 μm by lapping or the like. This will restrict the irregular reflection of light on the surface thereof (finally, the interface with the colored layer 62) and enhance the transmittance of light. Consequently, the quantity of light reaching the solar battery 4 placed on the rear side of the dial plate 6 increases, so that the solar battery generates more electromotive force.

Lapping can be done by using diamond abrasive grains having a grain diameter of about 3 μm.

On the contrary, barrel or honing processing can roughen the surface of the intermediate layer 63. In this case, the irregular reflection is strengthened on the surface (finally, the interface with the colored layer 62) of the intermediate layer 63, and the transmittance of light is decreased; however, the irregular reflection of light will present soft and warm color tones.

Figure 5:
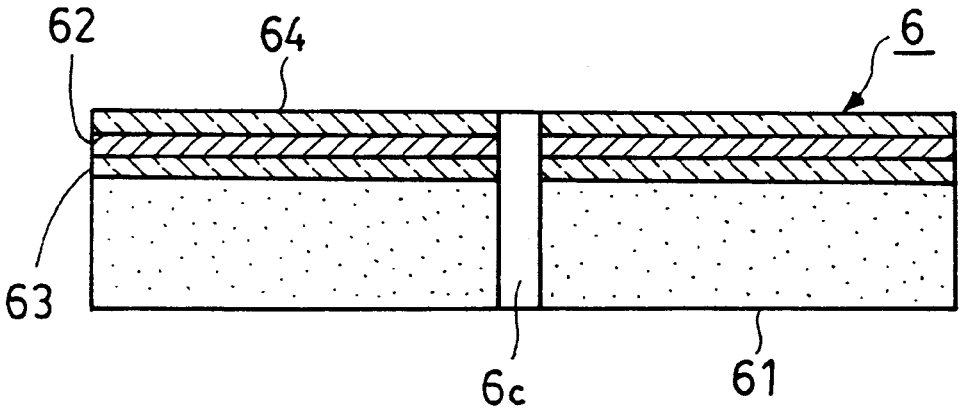
FIG. 5 is a sectional view showing another modified embodiment of a dial plate for a solar battery powered watch relating to the first embodiment.

FIG. 5 is a sectional view showing another modified embodiment of a dial plate for a solar battery powered watch relating to the first embodiment.

In this modified embodiment, the colored coating layer comprises a colored layer 62 described above, the intermediate layer 63, and additionally a surface layer 64.

The substrate 61, colored layer 62, and intermediate layer 63 in this modified embodiment are virtually the same as the ones described in the first embodiment and the modified embodiment of the same, thus a detailed description will be here omitted.

The surface layer 64 is formed on the surface of the colored layer 62, which makes the surface of the colored layer 62 glossy to enhance the color quality and protects the color of the colored layer 62 from decoloring.

This surface layer 64 can be formed of a low melting point glass such as a lead derivative or boric acid derivative that can form a glass film at a temperature (for example, 350 to 500° C.) sufficiently low compared to the baking temperature for the overglaze paint used for forming the colored layer 62.

First, glass powder of a low melting point is mixed with vehicle obtained by dissolving acrylic resin in a-terpineol, forming a glass paste having a low melting point. This paste is applied on the surface of the colored layer 62 by a screen printing method, writing brush, or paint brush. And then, the paste applied surface of the colored layer 62 is processed in a baking temperature of 350 to 500° C.; thus forming the surface layer 64. This baking treatment is processed in an oxidation atmosphere. The reason that the baking temperature of the surface layer 64 is set to a lower temperature than that of the colored layer 62 is to prevent the pigment of the colored layer 62 from diffusing into the surface layer 64.

Afterward, time scales, characters, symbols and the like are formed on the surface of the surface layer 64 depending on the need.

The surface of the surface layer 64 may be made smooth with a surface roughness of about 0.05 to 0.1 μm by lapping or the like. This will restrict the irregular reflection of light on the surface thereof and enhance the transmittance of light. Consequently, the quantity of light reaching the solar battery 4 placed on the rear side of the dial plate 6 increases, so that the solar battery generates more electromotive force.

Lapping can be done by using diamond abrasive grains having a grain diameter of about 3 μm.

According to the experiment made by the inventors of the present invention, in the dial plate where the surface of the surface layer 64 is made smooth by lapping and the surface of the same is not lapped, the transmittance of light of the former was increased by 3.5 to 5.0%.

On the contrary, barrel or honing processing can roughen the surface of the surface layer 64. In this case, the irregular reflection is strengthened on the surface of the surface layer 64, and the transmittance of light is decreased; however, the irregular reflection of light will present soft and warm color tones.

Varying the film formation thickness of the colored layer 62, intermediate layer 63, and surface layer 64 of the dial plate 6 makes the reflection and refraction of light not uniform, whereby various patterns can be formed.

In the modified embodiment described above, the intermediate layer 63 and the surface layer 64 are formed by using a ceramic glaze and a low melting point glass, respectively; however, at least one of the intermediate layer 63 and the surface layer 64 may be formed by an oxide film such as a silicon oxide film ($SiO_2$), tantalum oxide film ($Ta_2O_5$), or aluminum oxide film ($Al_2O_3$).

When the foregoing oxide film is applied to the intermediate layer 63, fine holes on the surface of the substrate 61 formed of a ceramic material are clogged, which prevents the colored layer 62 from soaking into the substrate 61. When the foregoing oxide film is applied to the surface layer 64, the surface of the colored layer 62 can be made glossy, which enhances the color quality and protects the colored layer 62 from decoloring.

These oxide films can be formed by the vacuum evaporation method, sputtering, chemical vapor deposition method and the like; the formation temperature may reliably be lower than 300° C. in each method. The oxide film formed will not change at all even if it is heated to a temperature higher than 1000° C. However generally, with these methods it is difficult to make the film thick, and a thickness thinner than a few $\mu$m cannot be avoided in practice; nevertheless, these oxide films have an equivalent effect to the case where a ceramic glaze or a low melting point glass is used.

Second Embodiment

Figure 6:
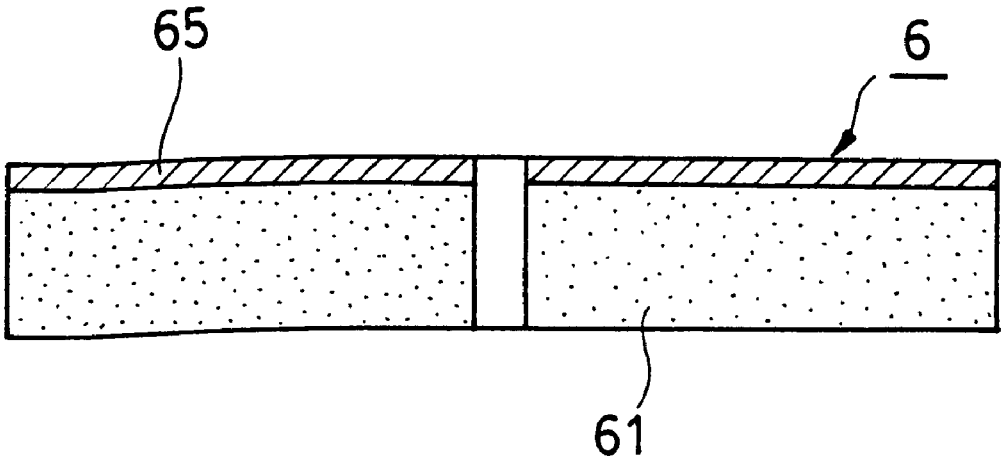
FIG. 6 is a sectional view showing the constitution of a dial plate for a solar battery powered watch relating to the second embodiment of the present invention.

FIG. 6 is a sectional view showing the constitution of the dial plate for a solar battery powered watch relating to the second embodiment of the present invention.

The dial plate relating to this embodiment can be applied, for example, to the dial plate for the solar battery powered watch shown in FIG. 3. The surface constitution of the dial plate relating to the second embodiment is the same as that of the dial plate of the first embodiment shown in FIG. 2.

The dial plate 6 for the solar battery powered watch relating to the second embodiment is characterized in that a mixed colored layer 65 as a colored coating layer is formed on the surface of the substrate 61.

The adjustment of transmittance has an important meaning for the dial plate 6 according to the second embodiment.

For example, it is preferable that the dial plate 6 has a transmittance of light capable of transmitting ¼ or more of the irradiated light so as to secure sufficient electric power for the solar battery 4 and to keep a steady driving of the watch. Further, it is preferable that the dial plate of a watch provided with an additive function such as an illuminating or alarming function which consumes much power has a transmittance of light capable of transmitting ⅓ or more of the irradiated light.

Meanwhile, it is preferable that the dial plate has a transmittance of light capable of transmitting ⅔ or less of the irradiated light to conceal the solar battery 4 (particularly the color thereof) from view. Further, if the dial plate 6 has a light color, it is preferable that the dial plate has a transmittance of light capable of transmitting ½ or less of the irradiated light so as to more securely conceal the solar battery 4 having a dark color such as dark violet.

In view of the security of the electric power and of the concealing of the solar battery 4, it is preferable that the transmittance of light of the dial plate 6 be adjusted.

As explained in the foregoing, it is preferable that the transmittance of light of the dial plate 6 be decided based on the ratio between the amount of the electric power of the solar battery 4 generated by the light irradiated on the solar battery 4 in a state where the dial plate 6 is not inserted and that of the solar battery 4 generated by the light transmitted through the dial plate 6 in a state where the dial plate 6 is inserted.

The constitution of the substrate 61 is the same as the one in the first embodiment described above; therefore, the description of the same will be omitted.

The mixed colored layer 65 is formed of a coloring material made by mixing a glass material such as a ceramic glaze and a paste of a low melting point glass with a ceramic paint. The ceramic glaze used in this embodiment is the same one as used for forming the intermediate layer 63 (FIG. 4, 5) in the first embodiment described above. And, the paste of a low melting point glass used herein is the same one as used for forming the surface layer 64 (FIG. 5) in the first embodiment.

As described above, there are transparent and lightly colored ceramic glazes; both of them may be used in this embodiment.

When a lightly colored ceramic glaze is used, it can be mixed with a ceramic paint, expanding color variation. On the other hand, when an achromatic transparent ceramic glaze is used, the transmittance of light is enhanced.

When the ceramic paint mixed with the ceramic glaze is used, an underglaze paint must be used which has a baking temperature equivalent or very close to the baking temperature for the ceramic glaze (for example, 1100 to 1300° C.). The reason is that obtaining a sufficient function of the glaze and the paint is impossible if the baking temperature is different with the ceramic glaze and the ceramic paint which are processed integrally simultaneously.

On the other hand, when the ceramic paint is used being mixed with a paste of a low melting point glass, it is preferable to use an overglaze paint having a low baking temperature of 700 to 900° C. as the ceramic paint and select the paste of a low melting point glass having virtually the same baking temperature. The paste of a low melting point glass in this embodiment is slightly different in composition from the one having a still lower baking temperature which is used in the first embodiment.

The ceramic paint used in this second embodiment also exerts substantially the same effect when it is used by the similar method to the one used in the foregoing first embodiment.

The ceramic paint used in the second embodiment is a paint formed in such a manner that a metal oxide as the metal compound is dispersed into water or oil and the viscosity is adjusted by using funori or the like, or a liquid pigment paint in which water-soluble metallic chloride as the metal compound is dissolved into water; different kinds of metal compound used produce different colors.

Using cobalt chloride or cobalt nitrate as the metal compound for the liquid pigment paint will produce a blue ceramic paint. Using iron chloride or iron sulfate will produce a yellow ceramic paint. Using ferric chloride or copper sulfate will produce a green ceramic paint. Using chromium sulfate or chromium nitrate will produce a brown ceramic paint. Using gold chloride will produce a pink ceramic paint.

Thus, selection of the kind of the metal compound will present various colors needed for designing the dial plate 6 for the watch.

Further, mixing several kinds of metal compounds described above in an appropriate ratio will produce a ceramic paint of different tone.

Mixing, for example, metal oxides of cobalt and chrome will produce a green spectrum ceramic paint. Mixing metal oxides of cobalt and manganese will produce a blue spectrum ceramic paint. Mixing metal oxides of gold and cobalt will produce a red-purple spectrum ceramic paint.

The mixed colored layer 65 is formed with a film thickness of about 20 to 30 μm. The transmittance of light can appropriately be adjusted by adjusting the film thickness.

Next, the method of manufacturing the dial plate 6 relating to the second embodiment will be described. The method of manufacturing the dial plate 6 can be divided into the method of manufacturing the substrate 61 and the formation of the mixed colored layer 65. The method of manufacturing the substrate 61 is just the same as the one in the first embodiment described above. Therefore herein, the description will be omitted.

The mixed colored layer 65 can be formed as follows.

First, a mixed coloring material is fabricated by mixing a ceramic paint with a ceramic glaze. A concrete manufacturing method will be presented herein which the inventors executed.

A metal oxide is dispersed in water and kneaded, which is processed in a heating treatment to evaporate moisture; after further being mixed, a powdery ceramic paint is made for use. A powdery ceramic glaze available in market was employed.

A mixed coloring material is fabricated in such a manner that a powdery ceramic paint and ceramic glaze are mixed in an appropriate ratio (for example, 1 to 5 in weight) and are well kneaded with oil added.

It is preferable to adjust the additive quantity of oil in consideration for the film thickness of the mixed colored layer 65 formed by the screen printing method and the screen printability.

Adjusting the quantity of oil added enhances the screen printability, whereby the film thickness of the mixed colored layer 65 becomes uniform and the periphery of the mixed colored layer 65 assumes a deep color.

This mixed coloring material is applied on the substrate 61 by the screen printing method. The film thickness of the mixed coloring material is adjusted to about 20 to 30 μm. The screen for use in the screen printing is selected out of 150 mesh to 200 mesh.

When the film thickness of the mixed coloring material is not adjusted to a desired one at the first screen printing, repeated application for several times is recommended.

Next, the baking treatment under a temperature of 1100 to 1300° C. is executed and the mixed colored layer 65 is formed. This treatment is executed in an atmosphere of oxidation or reduction.

Next, time scales, characters, and symbols are formed depending on the need.

The surface of the mixed colored layer 65 is made smooth with a surface roughness of about 0.05 to 0.1 μm by lapping or the like, which restricts the irregular reflection on the surface thereof and enhances the transmittance of light.

According to the comparison made by the inventors of the present invention, between the dial plate 6 where the surface of the mixed colored layer 65 is lapped and the surface of the same is not lapped, the transmittance of light of the former was increased by 3.0 to 5.0%.

Lapping the surface of the mixed colored layer 65 may be done by using diamond abrasive grains having a grain diameter of about 3 to 5 μm.

When the surface of the mixed colored layer 65 is lapped by using diamond abrasive grains, lapping the substrate 61 on the rear side is also preferable.

There is a possibility in lapping the mixed colored layer 65 that diamond abrasive grains and lapping residues are attached on the rear surface of the substrate 61, which can appear as contamination. To prevent this from occurring, lapping the substrate 61 on the rear surface to make it flat and smooth is effective in keeping the diamond abrasive grains and lapping residues from attaching thereon, thus making the surface difficult to be contaminated.

According to the comparison made by the inventors of the present invention, between the dial plate 6 where the rear surface of the substrate 61 is lapped and the rear surface of the same is not lapped, the transmittance of light of the former was increased by 1.5 to 2.5%. Lapping on the rear side of the substrate 61 is identically applicable as in the first embodiment.

When the contamination on the rear surface of the substrate 61 becomes apparent, baking the dial plate 6 under a temperature of 700 to 1000° C. and burning off the diamond abrasive grains and lapping residues may be performed to keep the surface clean. In this case, the baking temperature needs to be lower than the baking temperature for forming the colored coating layer.

The baking treatment for cleaning is performed in an atmosphere of oxidation or reduction. This baking treatment is also identically applicable to others except the one (FIG. 5) used for the surface layer 64 in the first embodiment.

On the other hand, barrel or honing processing can roughen the surface of the mixed colored layer 65. In this case, the irregular reflection is strengthened on the surface of the mixed colored layer 65, and the transmittance of light is decreased; however, the irregular reflection of light will present soft and warm color tones.

Raising the baking temperature of the mixed colored layer 65 to a temperature higher than the standard setting temperature will boil the ceramic glaze and low melting point glass, by which a fine pattern can be formed on the surface.

Figure 7:
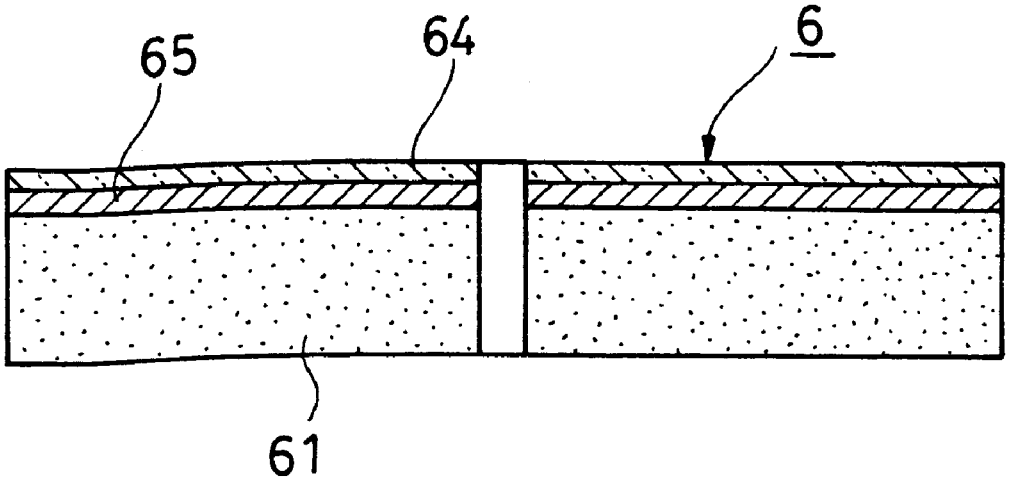
FIG. 7 is a sectional view showing the modified embodiment of a dial plate for a solar battery powered watch relating to the second embodiment.

FIG. 7 is a sectional view showing a modified embodiment of the dial plate for the solar battery powered watch relating to the foregoing second embodiment.

In this modified embodiment, the colored coating layer comprises the mixed colored layer 65 described above and the surface layer 64.

The substrate 61 and the mixed colored layer 65 in this modified embodiment are substantially the same as the ones described above in the second embodiment; therefore, a detailed description will be omitted.

The surface layer 64 can be formed of a low melting point glass in the same manner as the surface layer 64 (FIG. 5) formed on the surface of the colored layer 62 in the modified embodiment to the first embodiment. This surface layer 64 is formed with a film thickness of about 20 to 30 μm. For the low melting point glass used for the surface layer 64, one having a baking temperature sufficiently lower than that for the mixed colored layer 65 is selected, so that the surface layer 64 and the mixed colored layer 65 will not mutually diffuse.

Usually, the low melting point glass is transparent; adding a small quantity of pigment assumes a light color, with which ceramic paint is mixed to add a new color variation. On the other hand, when an achromatic low melting point glass is used, the transmittance of light can be increased.

It is preferable that the dial plate 6 has a transmittance of light capable of transmitting ¼ or more of the irradiated light so as to secure sufficient electric power for the solar battery 4 and to keep a steady driving of the watch. Further, it is preferable that the dial plate of a watch provided with an additive function such as an illuminating or alarming function which consumes much power has a transmittance of light capable of transmitting ⅓ or more of the irradiated light.

Meanwhile, it is preferable that the dial plate has a transmittance of light capable of transmitting ⅔ or less of the irradiated light to conceal the solar battery 4 (particularly the color thereof) from view. Further, if the dial plate 6 has a light color, it is preferable that the dial plate has a transmittance of light capable of transmitting ½ or less of the irradiated light so as to more securely conceal the solar battery 4 having a dark color such as dark violet.

In view of the security of the electric power and of the concealing of the solar battery 4, it is preferable that the transmittance of light of the dial plate 6 be adjusted.

As explained in the foregoing, it is preferable that the transmittance of light of the dial plate 6 be decided based on the ratio between the amount of electric power of the solar battery 4 generated by the light irradiated on the solar battery 4 in a state where the dial plate 6 is not inserted and that of the solar battery 4 generated by the light transmitted through the dial plate 6 in a state where the dial plate 6 is inserted.

The surface layer 64 can be formed on the surface of the mixed colored layer 65 by the following method.

First, a glass powder of a low melting point such as a lead derivative or boric acid derivative is prepared which can form a glass film at a temperature (for example, 350 to 500° C.) sufficiently lower than the baking temperature for the mixed colored layer 62. And, this glass powder is kneaded with a vehicle obtained by dissolving acrylic resin in a-terpineol. The quantity of the vehicle added is preferably adjusted in consideration for the film thickness of the surface layer 64 formed by the screen printing method and the screen printability.

The glass paste of a low melting point thus adjusted is applied on the surface of the mixed colored layer 65 by the screen printing method. The film thickness of a low melting point glass is adjusted to about 20 to 30 μm. And, the screen used for the screen printing is about 150 to 200 mesh.

When the film thickness of a low melting point glass is not adjusted to a desired one at the first screen printing, repeated application for several times is recommended.

And then, a baking treatment is processed under the temperature of 350 to 500° C.; thus forming the surface layer 64. This baking treatment may be processed in an oxidation atmosphere.

Afterward, time scales, characters, symbols and the like are formed on the surface of the surface layer 64 depending on the need.

Lapping the surface of the surface layer 64 will produce a smooth surface with a surface roughness of about 0.05 to 0.1 μm; thus the irregular reflection on the surface can be reduced and the transmittance of light will be increased.

The inventor of the present invention made two types of dial plates 6, one where the surface of the surface layer 64 was made smooth by lapping, and another where the surface was not lapped, and compared the transmittance of light between these two types. It was found that the transmittance of light of the former was increased by 3.0 to 5.0%.

Lapping the surface of a surface layer 64 may be done by using diamond abrasive grains having a grain diameter of about 3 to 5 μm.

When the surface of the surface layer 64 is lapped by using diamond abrasive grains, lapping the substrate 61 on the rear side is also preferable.

There is a possibility in lapping the surface layer 64 that diamond abrasive grains and lapping residues are attached on the rear surface of the substrate 61, which can appear as contamination. To prevent this from occurring, lapping the substrate 61 on the rear surface to make it flat and smooth is effective in keeping the diamond abrasive grains and lapping residues from attaching thereon, thus making the surface difficult to contaminate.

According to the comparison made by the inventors of the present invention, between the dial plate 6 where the rear surface of the substrate 61 is lapped and the rear surface of the same is not lapped, the transmittance of light of the former was increased by 1.5 to 2.5%.

On the other hand, barrel or honing processing can roughen the surface of the surface layer 64. In this case, the irregular reflection is strengthened on the surface of the surface layer 64, and the transmittance of light is decreased; however, the irregular reflection of light will present soft and warm color tones.

Varying the film thickness formed of the mixed colored layer 65 and surface layer 64 of the dial plate 6 makes the reflection and refraction of light not uniform, whereby various patterns can be formed.

In the modified embodiment described above, the surface layer 64 was formed by using glass of a low melting point; however, the surface layer 64 may be formed by an oxide film such as a silicon oxide film ($SiO_2$), tantalum oxide film ($Ta_2O_5$), or aluminum oxide film ($Al_2O_3$).

These oxide films can be formed by the vacuum evaporation method, sputtering, chemical vapor deposition method or the like; the formation temperature may reliably be lower than 300° C. in each method. The oxide film formed will not change at all even if it is heated to a temperature higher than 1000° C. However generally, with these methods it is difficult to make the film thick, and the thickness thinner than a few μm cannot be avoided in practice; nevertheless, these oxide films have an equivalent effect to the case where a ceramic glaze or glass of a low melting point is used.

Third Embodiment

Figure 8:
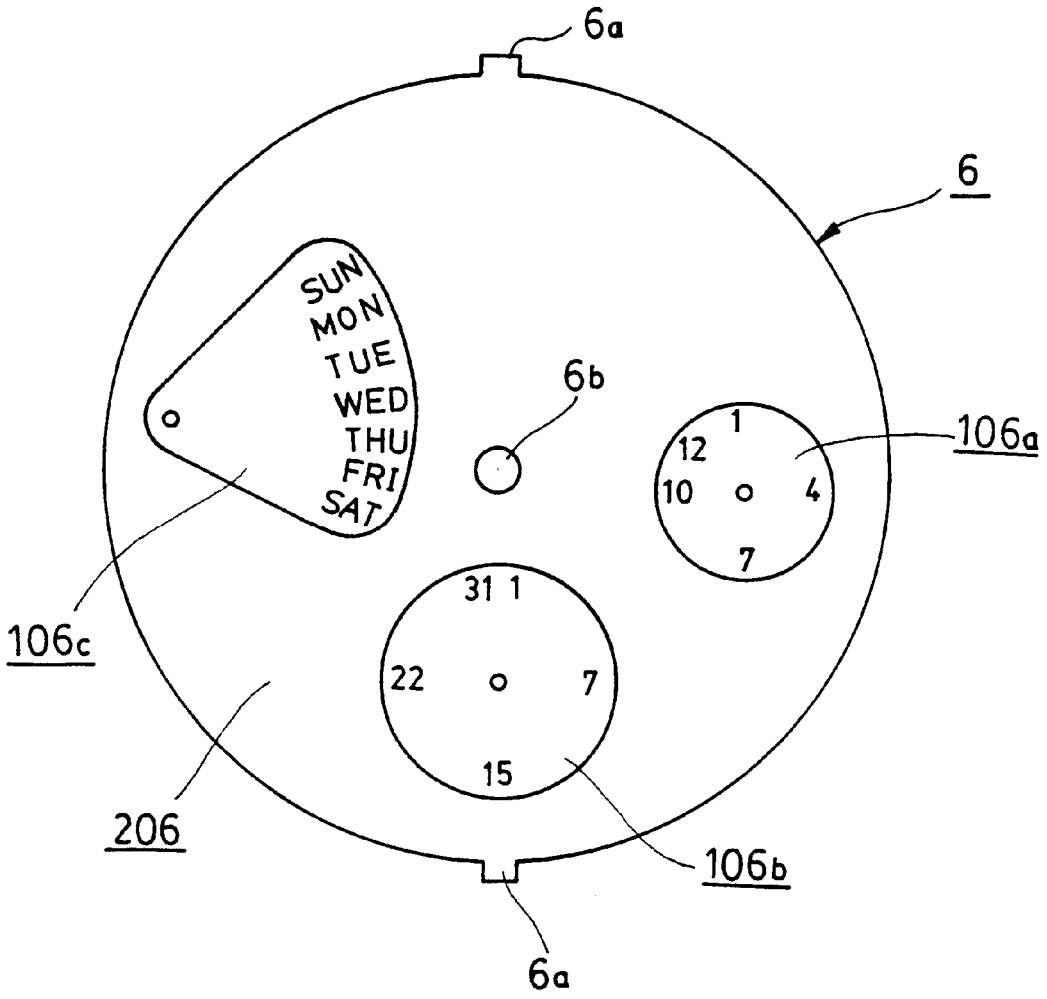
FIG. 8 is a plan view showing the constitution of a dial plate for a solar battery powered watch relating to the third embodiment of the present invention.

FIG. 8 is a plan view showing an example of the surface constitution of the dial plate for the solar battery powered watch relating to the third embodiment of the present invention.

Dial plates for solar battery powered watches have regions (additive functional regions) for various additive functions such as time indication function for the 24 hour system, a date indication function, a day indication function, a stopwatch function, and time-difference indication function.

In FIG. 8, for example, 106*a* is an additive functional region for indicating the month of the year, 106*b* is an additive functional region for indicating the date of the month, and 106*c* is an additive functional region for indicating the day of the week.

Differentiating the color tone for the additive functional regions, 106*a*, 106*b*, 106*c* from the other region 206 (non-additive functional region) on the surface of the dial plate 6 makes the additive functional regions easy to view, enhances functionability, and presents novelty in design appearance.

In the dial plate 6 of the third embodiment, the additive functional regions, 106*a*, 106*b*, 106*c* bear a construction so as to differentiate their color tone from the other additive functional region 206 so as to obtain the above-mentioned effect.

Figure 9:
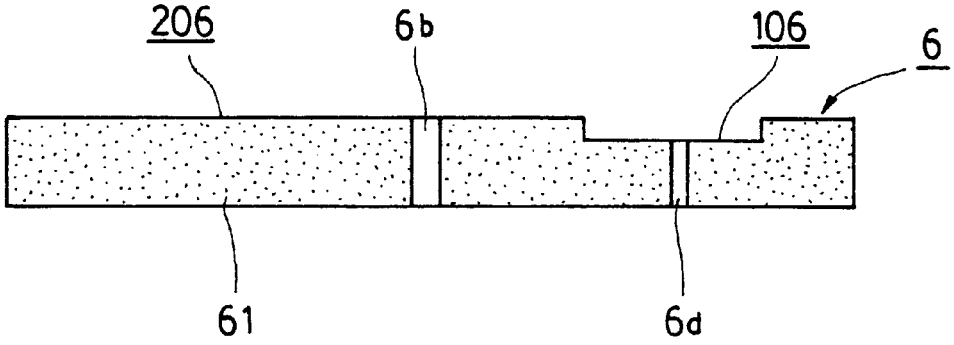
FIG. 9 is a sectional view showing the constitution of a dial plate for a solar battery powered watch relating to the third embodiment of the present invention.

In the dial plate 6 of the third embodiment, as shown in FIG. 9, the surface for the additive functional region 106

(representative reference symbol for 106*a*, 106*b*, 106*c*) is formed in a recessed shape so that the thickness of the region is thinner compared to the non-additive functional region 206.

The constitutional materials and the manufacturing method of the substrate 61 may be the same as the ones in the first embodiment described above. However, a metal mold is needed to form the recessed shape for the additive functional region 106 shown in FIG. 8, and to form a throughhole 6*d* to accommodate a drive shaft for an auxiliary hand (for date, day, etc.) depending on the need.

It is preferable that the dial plate 6 formed of the substrate 61 has a transmittance of light capable of transmitting ¼ or more of the irradiated light so as to secure sufficient electric power for the solar battery 4 and to keep a steady driving of the watch. Further, it is preferable that the dial plate of a watch provided with an additive function such as an illuminating or alarming function for consuming much power has a transmittance of light capable of transmitting ⅓ or more of the irradiated light.

Meanwhile, it is preferable that the dial plate has a transmittance of light capable of transmitting ⅔ or less of the irradiated light to conceal the solar battery 4 (particularly the color thereof) from view. Further, if the dial plate 6 has a light color, it is preferable that the dial plate has a transmittance of light capable of transmitting ½ or less of the irradiated light so as to more securely conceal the solar battery 4 having a dark color such as dark violet.

In view of the security of the electric power and of the concealing of the solar battery 4, it is preferable that the transmittance of light of the dial plate 6 be adjusted.

As explained in the foregoing, it is preferable that the transmittance of light of the dial plate 6 be decided based on the ratio between the amount of electric power of the solar battery 4 generated by the light irradiated on the solar battery 4 in a state where the dial plate 6 is not inserted and that of the solar battery 4 generated by the light transmitted through the dial plate 6 in a state where the dial plate 6 is inserted.

The dimension of thickness of the substrate 61 is adjusted appropriately in consideration for the strength and for the transmittance of light. That is, the strength must be enough to withstand the usage for the dial plate of a watch and the transmittance is adjusted so as to securely transmit about ⅓ to ⅔ of the quantity of incident light.

To form the additive functional region 106 and the non-additive functional region 206 in different thickness differentiates the transmittance and diffusivity of incident light on the substrate 61 formed of a ceramic material in the additive functional region 106 from those in the non-additive functional region 206. Consequently, both the regions 106, 206 assume different color tones.

Ambient light incident on the dial plate 6 irregularly reflects on the surface and inside of the dial plate 61, a portion of which comes out of the dial plate 6 as reflected light. On the other hand, as shown in FIG. 3, a colored solar battery 4 (usually, red-purple) is placed on the rear side of the dial plate 6. Light transmitted through the dial plate 6 of the ambient light incident on the dial plate 6 is reflected on the solar battery 4, which falls on the dial plate 6 from the back side, colored by the solar battery 4. A portion of the colored light falling on the dial plate 6 from the back side is reflected and the other portion transmits diffusedly through to the front surface of the dial plate 6. The transmittance and the reflection coefficient of light which are given by a series of transmissions and reflections through the dial plate 6 depend on the thickness of the dial plate 6 (namely, the substrate 61) and the diffusivity of light, and the additive functional region 106 having a thinner thickness bears a higher transmittance of light. Consequently, the additive functional region 106 and the non-additive functional region 206 assume different color tones.

When the substrate 61 is formed of a milky white ceramic material, the thicker non-additive functional region 206 reflects more surrounding incident light. This reflection light is white. When the light transmitted through the region 206 and reflected on the solar battery 4 again is transmitted through the region 206 to the front surface, the quantity of light becomes minute. Therefore, the non-additive functional region 206 assumes a milky white appearance.

On the other hand, since the transmission of colored light increases in the thinner functional region 106, the milky white of the substrate 61 and the red-purple of the solar battery 4 are mixed to assume a gray color.

Further, the thickness of the functional region 106 in the substrate 61 can be made thinner by forming a recessed part on the back side thereof. Forming a recessed part on the front or back surface of the non-additive functional region 206 to make the thickness thinner than that of the additive functional region 106 will also assume different color tones in each region.

Fourth Embodiment

FIGS. 10 to 13 are sectional views showing the constitution of the dial plate for a solar battery powered watch relating to the fourth embodiment of the present invention.

The dial plate relating to this embodiment can also be applied to the dial plate 6 for the solar battery powered watch having, for example, the additive functional regions 106*a*, 106*b*, 106*c* shown in FIG. 8.

In the dial plate 6 for the solar battery powered watch relating to the fourth embodiment, a colored coating layer is formed on the bottom of the recessed part formed in the additive functional regions 106, whereby the additive functional regions 106 and the non-additive functional region 206 differ in color.

Figure 10:
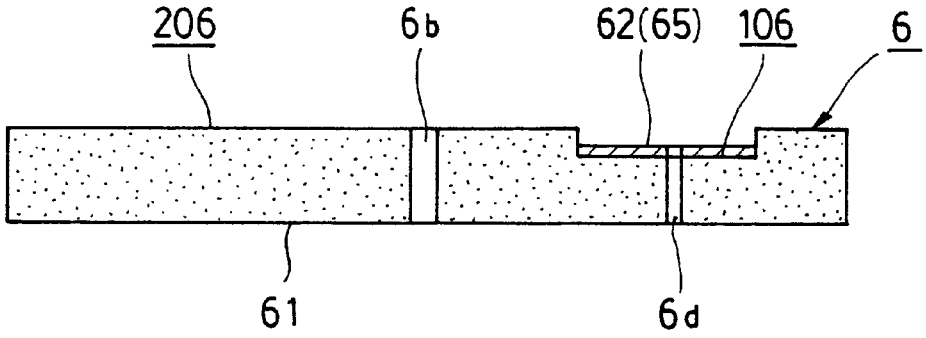
FIG. 10 is a sectional view showing the constitution of a dial plate for a solar battery powered watch relating to the fourth embodiment of the present invention.

The dial plate 6 shown in FIG. 10, for example, has the colored layer 62 as a colored coating layer formed on the bottom of a recessed part formed in the additive functional region 106.

This colored layer 62 can be formed by using a ceramic paint in the same manner as forming the colored layer 62 in the first embodiment described above. In this case, since only the colored layer 62 is formed by the ceramic paint in the additive functional region 106, the baking temperature of the ceramic paint is not a factor.

Figure 11:
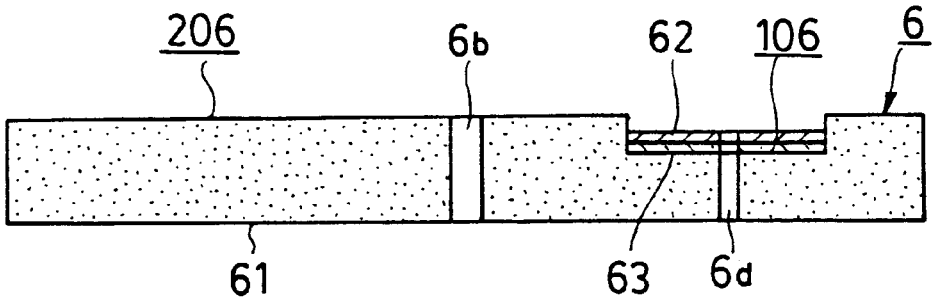
FIG. 11 is a sectional view showing the constitution of the fourth embodiment comprising an intermediate layer and colored layer.

When the colored layer 62 is formed directly on the surface of the substrate 61, the ceramic paint may soak into the substrate 61 to blur the circumferential edges. In order to prevent the cicumferential edges from being blurred, as shown in FIG. 11, the intermediate layer 63 may be formed between the substrate 61 and the colored layer 62 so as to form a colored coating layer with the colored layer 62 and the intermediate layer 63.

The intermediate layer 63 may be formed using a glass material such as a ceramic glaze in the same manner as the intermediate layer 63 in the modified embodiment to the first embodiment described above.

When the intermediate layer 63 is formed, in the same manner as the first embodiment, the ceramic paint for the colored layer 62 is used which has a lower baking temperature than that of the glass material of the intermediate layer 63.

And, for a replacement of the colored layer 62 shown in FIG. 10, the mixed colored layer 65 in the second embodiment described above may be formed as a colored coating layer, in the additive functional region 106 of the dial plate 6.

The mixed colored layer 65 is formed by a mixed coloring material which is formed by mixing a glass material such as a ceramic glaze or a low melting point glass with a ceramic paint. The adjustment of the mixed coloring material and the formation of the mixed colored layer 65 may be executed by the same method as in the second embodiment.

The ceramic paint is used which has a baking temperature virtually equal to that of a glass material such as a ceramic glaze or a low melting point glass.

Figure 12:
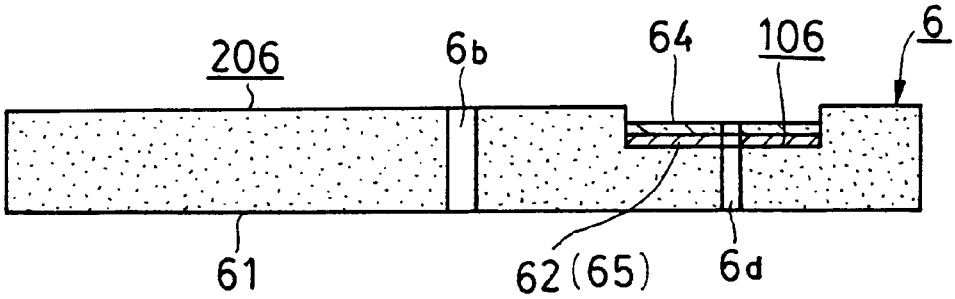
FIG. 12 is a sectional view showing the constitution of the fourth embodiment comprising a colored layer and surface layer.

In the dial plate 6 shown in FIG. 12, a surface layer 64 is further formed on the surface of the colored layer 62 or the mixed colored layer 65 formed in the additive functional region 106, whereby the coating layer comprises the colored layer 62 or the mixed colored layer 65 and the surface layer 64. The surface layer 64 can be formed by using virtually the same material and method as the ones used for forming the surface layer 64 in the modified embodiment to the first and second embodiment.

Figure 13:
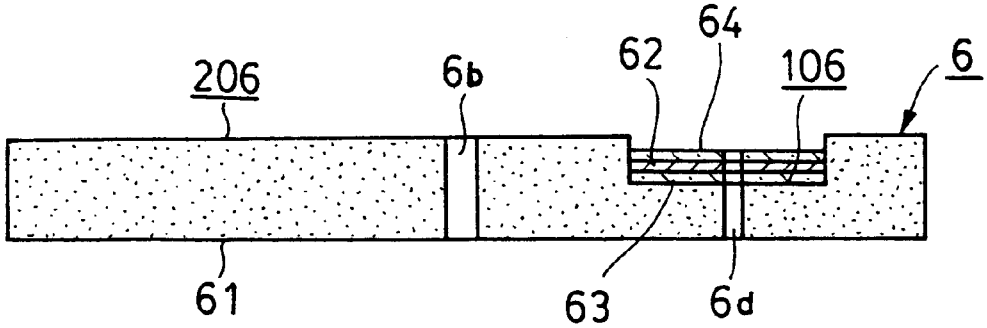
FIG. 13 is a sectional view showing the constitution of the fourth embodiment comprising an intermediate layer, colored layer, and surface layer.

And, in the dial plate shown in FIG. 13, the intermediate layer 63, the colored layer 62, and the surface layer 64 are formed as a colored coating layer, on the bottom of the recessed part formed in the additive functional region 106. The constitution and formation method of the intermediate layer 63, the colored layer 62, and the surface layer 64 are virtually the same as those of the intermediate layer 63, the colored layer 62, and the surface layer 64 in the first embodiment and its modified embodiment described above.

Forming a colored coating layer in the additive functional region 106, as mentioned above, will assume different color tones in the additive functional region 106 and the non-additive functional region 206.

Further, in the above-mentioned constitution, the colored coating layer is formed on the bottom of the recessed part formed in the additive functional region 106; however on the contrary, the colored coating layer may be formed in the non-additive functional region 206. And, different colored coating layers may be formed each in the additive functional region 106 and the non-additive functional region 206 to differentiate the color tone in each region.

In a recessed part formed in the non-additive functional region 206, and also in a recessed part formed on the back surface of the substrate 61, corresponding to the additive functional region 106 or the non-additive functional region 206, the color tone in each region can be differentiated by the combination of the foregoing coating layer.

Fifth Embodiment

FIGS. 14 to 17 are sectional views showing the constitution of the dial plate for a solar battery powered watch relating to the fifth embodiment of the present invention.

The dial plate relating to this embodiment can also be applied to the dial plate 6 for the solar battery powered watch having, for example, the additive functional regions 106*a*, 106*b*, 106*c* shown in FIG. 8.

The dial plate 6 for the solar battery powered watch relating to the fifth embodiment does not form a recessed part on the front or back surface of the substrate 61, but flattens these surfaces. And, colored coating layers are formed with different color tones so as to differentiate the additive functional region 106 from the non-additive functional region 206.

Figure 14:
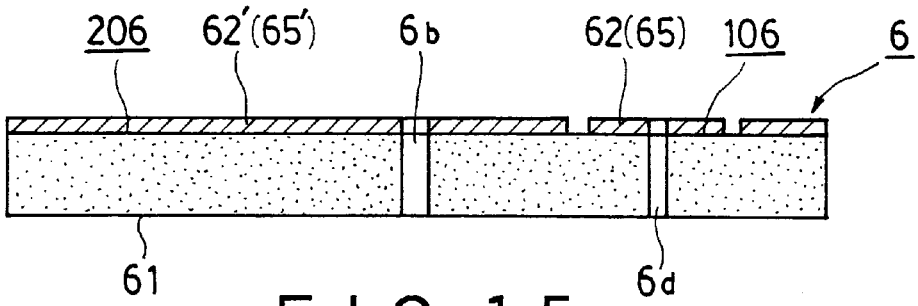
FIG. 14 is a sectional view showing the constitution of a dial plate for a solar battery powered watch relating to the fifth embodiment of the present invention.

In the dial plate 6 shown in FIG. 14, for example, two colored layers 62, 62' in different colors are formed as the coating layer, on portions of regions corresponding to the additive functional region 106 and the non-additive functional region 206.

These colored layers 62, 62' can be formed using the ceramic paint in the same manner as the colored layer 62 in the first embodiment described above. In this case, only the colored layers 62, 62' formed of ceramic paints are formed on the surface of the substrate 61, and hence, the baking temperature of ceramic paints is not a factor.

Figure 15:
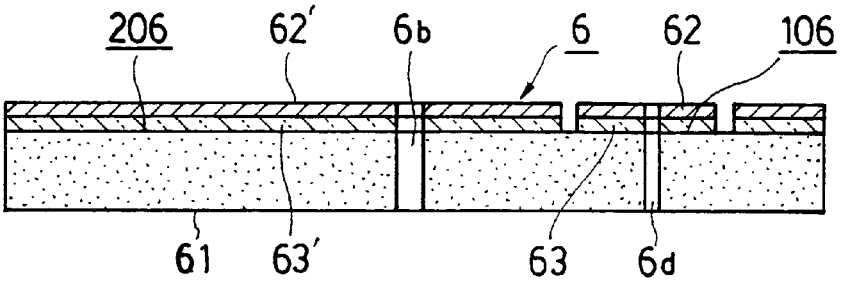
FIG. 15 is a sectional view showing the constitution of the fifth embodiment comprising an intermediate layer and colored layer.

When the colored layers 62, 62' are directly formed on the surface of the substrate 61, the ceramic paint may be soaked into the substrate 61 to blur the circumferential edges as described above. In order to avoid the color of the circumferential edges from being blurred, as shown in FIG. 15, intermediate layers 63, 63' may be formed in the substrate 61 and below the colored layers 62, 62' so as to form colored coating layers with the colored layers 62, 62' and the intermediate layers 63, 63'.

The intermediate layers 63, 63' may be formed by using ceramic glazes in the same manner as the intermediate layer 63 in the modified embodiment to the first embodiment. The intermediate layer 63 and 63' may be formed of same type of material or different types of material.

When the intermediate layers 63, 63' are formed, the ceramic paints for the colored layers 62, 62', are used which have lower baking temperatures than those of the ceramic glazes for the intermediate layers 63, 63'.

And, for the replacement of the colored layers 62, 62' shown in FIG. 14, the mixed colored layers 65, 65' in the second embodiment described above may be formed as colored coating layers, in the additive functional region 106 and in the non-additive functional region.

Differentiating the color of the mixed colored layer 65 formed in the additive functional region 106 from the color of the mixed colored layer 65' formed in the non-additive functional region 206, varies the color tone in each region.

The mixed colored layers 65, 65' can be formed by a mixed coloring material which is formed by mixing a glass material such as a ceramic glaze or a low melting point glass with a ceramic paint. The adjustment of the mixed coloring material and the formation of the mixed colored layers 65, 65' may be executed by the same method as in the second embodiment described above.

The ceramic paint is used which has a baking temperature virtually equal to that of a glass material such as a ceramic glaze or a low melting point glass.

Figure 16:
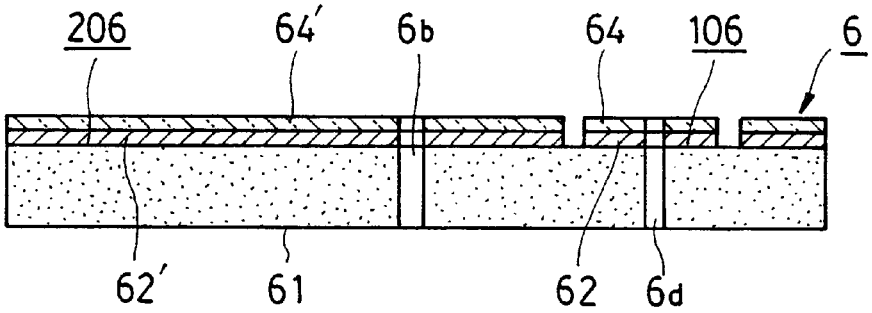
FIG. 16 is a sectional view showing the constitution of the fifth embodiment comprising a colored layer and surface layer.

In the dial plate 6 shown in FIG. 16, surface layers 64, 64' are further formed on the surface of the colored layers 62, 62' or the mixed colored layers 65, 65', each of which has a different color and is formed on the substrate 61, whereby the coating layer comprises the colored layers 62, 62' or the mixed colored layers 65, 65' and the surface layers 64, 64'.

The surface layers 64, 64' can be formed by using virtually the same material and method as the ones used for forming the surface layer 64 in the modified embodiment to the first and second embodiment.

Figure 17:
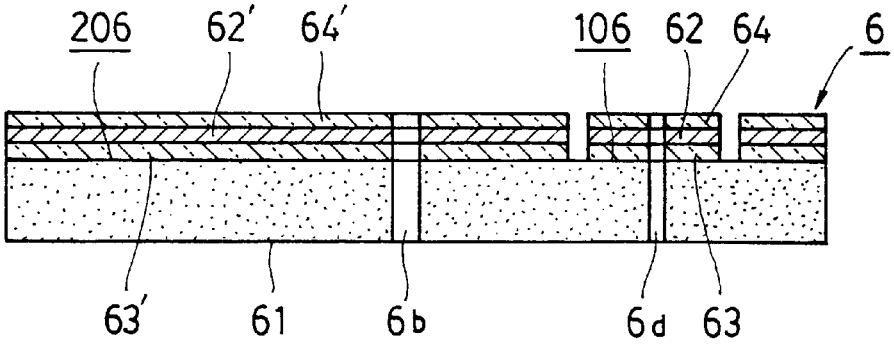
FIG. 17 is a sectional view showing the constitution of the fifth embodiment comprising an intermediate layer, colored layer, and surface layer.

And, in the dial plate 6 shown in FIG. 17, colored coating layers are formed on the surface of the base plate 61, which comprise the intermediate layers 63, 63', the colored layers 62, 62', and the surface layers 64, 64'. The colored layer 62 formed in the additive functional region 106 and the colored layer 62' formed in the non-additive functional region 206 are formed by the ceramic paints in different colors.

The constitution and formation method of the intermediate layers 63, 63', the colored layers 62, 62,' and the surface layers 64, 64' are virtually the same as those of the intermediate layer 63, the colored layer 62, and the surface layer 64 in the first embodiment and its modified embodiment described above.

Forming colored coating layers in different colors in the additive functional layer 106, and the non-additive functional region 206, as mentioned above, will differentiate the additive functional region 106 from the non-additive functional region 206.

Further, in the abovementioned constitution, the colored coating layers are formed on the surface of the substrate 61, however different colored coating layers can be formed each in the additive functional region 106 and the non-additive functional region 206 to differentiate the color tone in each region.

And, forming a colored coating layer in either the additive functional region 106 or the non-additive functional region 206 will present different color tones to both the regions.

Furthermore, forming the colored coating layer of the additive functional region 106 and non-additive functional region 206 separately on the front and back surface of the substrate 61 can differentiate the color tones for each region.

Lapping the front or back surface of the substrate 61 will produce a smooth surface with a surface roughness of about 0.05 to 0.1 $\mu$m; thus the irregular reflection on the surface can be reduced and the transmittance of light will be enhanced. Particularly when the colored layers 62, 62' are formed directly on the substrate 61, lapping the surface of the substrate 61 for forming the colored layers thereon will keep the ceramic paint from soaking into.

Further, after forming the colored layers 62, 62' and the mixed colored layers 65, 65', irregularly lapping or grinding these surfaces 62, 62' or 65, 65' will form patterns thereon and change the color tones.

When forming colored layers in more than two layers, varying the forming thickness of each layer in the dial plate 6 causes the reflection and refraction of light to be uneven and makes various patterns.

INDUSTRIAL UTILIZATION

The present invention can apply to a dial plate for a solar battery powered watch which operates using the solar battery as an energy source, and it can conceal the solar battery from view and satisfy the various tastes of purchasers by the various possible color variations.

What is claimed is:

1. A dial plate for a solar battery powered watch provided with a solar battery, to be disposed on the front side of the solar battery, comprising:

a substrate formed of a ceramic material; and a colored coating layer formed on a front surface of the substrate, wherein the colored coating layer has a colored layer formed of a ceramic paint containing a metal compound as a principal component.

2. A dial plate for a solar battery powered watch as claimed in claim 1, wherein the colored coating layer has an intermediate layer which is formed of either a glass film or a metal oxide film, between the colored layer and the substrate.

3. A dial plate for a solar battery powered watch as claimed in claim 2, wherein the colored coating layer has a surface layer which is formed of either a glass film or a metal oxide film, on the surface of the colored layer.

4. A dial plate for a solar battery powered watch as claimed in claim 3, wherein the front surface of the substrate is a flat surface made smooth by lapping.

5. A dial plate for a solar battery powered watch as claimed in claim 3, wherein the front surface of the substrate is a rough surface.

6. A dial plate for a solar battery powered watch as claimed in claim 3, wherein a surface of the surface layer is a flat surface made smooth by lapping.

7. A dial plate for a solar battery powered watch as claimed in claim 3, wherein a surface of the surface layer is a rough surface.

8. A dial plate for a solar battery powered watch provided with a solar battery, to be disposed on a front side of the solar battery, comprising:

a substrate formed of a ceramic material; and a colored coating layer formed on a front surface of the substrate, wherein the colored coating layer has a mixed colored layer formed by a coloring material mixed with one of a glass material or an oxide material and a ceramic paint containing a metal compound as a principal component.

9. A dial plate for a solar battery powered watch as claimed in claim 8, wherein the front surface of the substrate is a flat surface made smooth by lapping.

10. A dial plate for a solar battery powered watch as claimed in claim 8, wherein the front surface of the substrate is a rough surface.

11. A dial plate for a solar battery powered watch as claimed in claim 8, wherein a surface of the mixed colored layer is a flat surface made smooth by lapping.

12. A dial plate for a solar battery powered watch as claimed in claim 8, wherein a surface of the mixed colored layer is a rough surface.

13. A dial plate for a solar battery powered watch as claimed in claim 8, wherein the colored coating layer has a surface layer which is formed of either a glass film or a metal oxide film, on a surface of the mixed colored layer.

14. A dial plate for a solar battery powered watch as claimed in claim 13, wherein a surface of the surface layer is a flat surface made smooth by lapping.

15. A dial plate for a solar battery powered watch as claimed in claim 13, wherein a surface of the surface layer is a rough surface.

16. A dial plate for a solar battery powered watch as claimed in claim 14, wherein a back surface of the substrate is a flat surface made smooth by lapping.

17. A dial plate for a solar battery powered watch provided with a solar battery, disposed on a front side of the solar battery, said dial plate having predetermined additive functional regions and a non-additive functional region on a front surface thereof, comprising:

a substrate which is formed of a ceramic material and provided with said additive and non-additive functional regions wherein said additive and non-additive functional regions differ in thickness from each other.

18. A dial plate for a solar battery powered watch as claimed in claim 17, wherein a colored layer formed of a coloring material containing at least a ceramic coloring paint containing a metal compound as a principal component is formed on at least either the additive functional regions or non-additive functional region formed on the substrate.

19. A dial plate for a solar battery powered watch as claimed in claim 18, wherein an intermediate layer formed of either a glass film or an oxide film is formed between the colored layer and the substrate.

20. A dial plate for a solar battery powered watch as claimed in claim 19, wherein a surface layer formed of either a glass film or an oxide film is formed on a surface of the colored layer.

21. A dial plate for a solar battery powered watch provided with a solar battery, disposed on the front side of the solar battery, said dial plate having predetermined additive functional regions and a non-additive functional region on a front surface thereof, comprising:

a substrate which is formed of a ceramic material and provided with said additive and non-additive functional regions, wherein on at least one of said additive or non-additive functional regions a colored layer is formed of a coloring material containing at least a ceramic paint containing a metal compound as a principal component.

22. A dial plate for a solar battery powered watch as claimed in claim 21, wherein an intermediate layer formed of a glass film or an oxide film is formed between the colored layer and the substrate.

23. A dial plate for a solar battery powered watch as claimed in claim 22, wherein a surface layer formed of a glass film or an oxide film is formed on a surface of the colored layer.

* * * * *